United States Patent [19]

Andersson et al.

[11] 4,074,777

[45] Feb. 21, 1978

[54] PNEUMATIC IMPACT TOOL

[75] Inventors: Sture Roland Andersson, Saltsjo-Duvnas; Heino Elmessaar, Lidingo, both of Sweden

[73] Assignee: Atlas Copco Aktiebolag, Nacka, Sweden

[21] Appl. No.: 776,741

[22] Filed: Mar. 11, 1977

Related U.S. Application Data

[63] Continuation of Ser. No. 601,160, Aug. 1, 1975, abandoned.

[30] Foreign Application Priority Data

Aug. 8, 1974 Sweden ..... 7410147

[51] Int. Cl.[2] ..... B25D 9/06

[52] U.S. Cl. ..... 173/138; 173/139; 173/162; 91/234; 91/5

[58] Field of Search ..... 91/234, 5; 173/134, 173/136, 139, 162

[56] References Cited

U.S. PATENT DOCUMENTS

| | | | |
|---|---|---|---|
| 691,420 | 1/1902 | Vaughan | 91/234 |
| 742,934 | 11/1903 | Vaughan et al. | 91/5 |
| 1,128,416 | 2/1915 | Crump | 91/234 |
| 2,899,934 | 8/1959 | Salengro | 173/162 X |
| 3,241,239 | 3/1966 | Ellis | 91/234 X |
| 3,453,657 | 7/1969 | Bolton et al. | 173/136 X |
| 3,625,295 | 12/1971 | Gunning | 91/5 |
| 3,851,713 | 12/1974 | Fedosenko et al. | 91/5 |
| 3,920,086 | 11/1975 | Goppen | 173/162 X |

*Primary Examiner*—Ernest R. Purser
*Assistant Examiner*—William F. Pate, III
*Attorney, Agent, or Firm*—Flynn & Frishauf

[57] ABSTRACT

A pneumatic impact tool comprising a housing, an open ended cylinder inserted therein and a hammer piston reciprocably guided within the cylinder. In the forward end of the cylinder there is received the shank of a chisel onto which the hammer piston imparts impacts. The piston is a differential piston having its big end facing the chisel and forming around its rear, small diameter neck a rear annular, constantly pressurized chamber which continuously communicates with the pressure air inlet through a pulsator chamber. The forward cylinder chamber, enclosed between the chisel shank and the piston front area, is intermittently pressurized through an internal passage of the piston, which passage is periodically connected to the pressure air inlet by means of valve openings in the piston neck.

12 Claims, 4 Drawing Figures

PNEUMATIC IMPACT TOOL

This is a continuation, of application Ser. No. 601,160, filed Aug. 1, 1975 now abandoned.

This invention relates to pneumatic impact tools, for instance chipping hammers having a cylinder and a hammer piston reciprocable therein, which hammer piston has a piston area in a forward cylinder chamber and a piston area in a rear cylinder chamber, and the entire reaction force exerted by the pressure air in the rear cylinder chamber is absorbed by the impact device housing, whereas the entire reaction force exerted by the pressure air in the forward cylinder chamber is absorbed by the chisel.

In a suggested impact tool of this type the piston is cylindrical and driven in its impact direction by a constant acting pressure and in its reverse direction by a higher pressure. A time controlled valve alternatively loads the forward piston area with the higher pressure and unloads the same. Under certain circumstances such an impact tool may be essentially vibrationfree but it is complicated and bulky.

According to the invention there is obtained a practically vibration less impact tool which is constructively very simple and has a low weight. It also has surprisingly good start and operating characteristics. The invention has been given the characteristic features stated in the claims.

BRIEF DESCRIPTION OF THE DRAWINGS

A preferred embodiment of the invention is hereinafter described in detail with reference to the accompanying drawings on which

DETAILED DESCRIPTION

Figure 1:
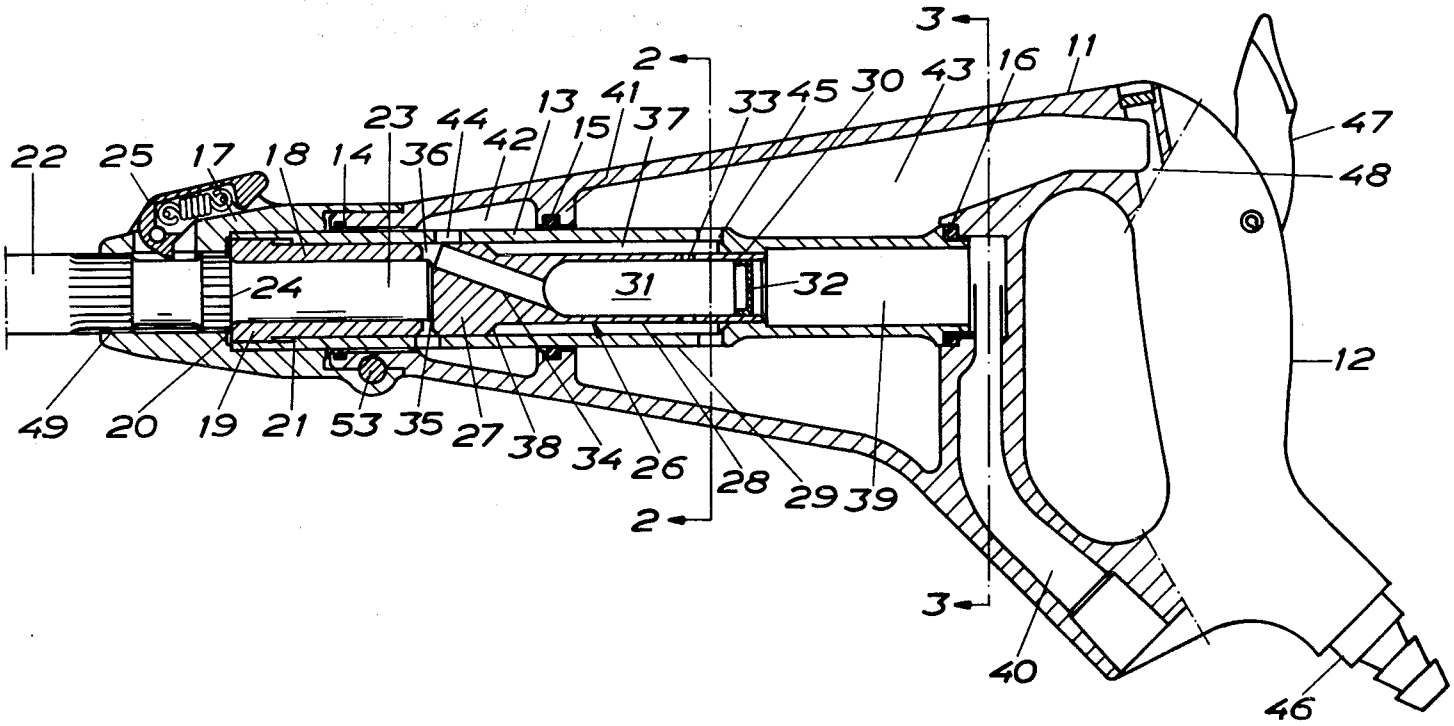
FIG. 1 shows a logitudinal section through a chipping hammer according to the invention.
Figure 2:
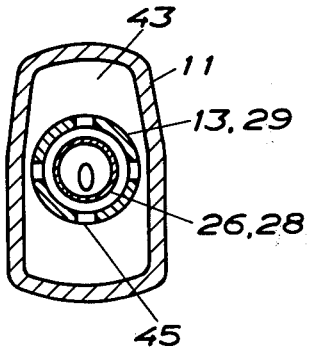
FIG. 2 shows a cross section taken along line 2—2 in FIG. 1.
Figure 3:
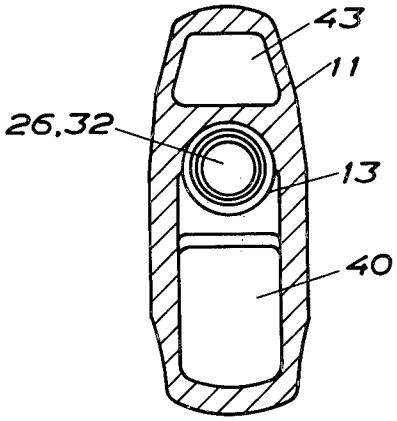
FIG. 3 shows a cross section taken along line 3—3 in FIG. 1.

The chipping hammer shown in FIGS. 1 - 3 has a housing 11 formed with a handle 12. A cylinder 13 which is open at both ends is introduced into the housing from the front end of the latter. The cylinder has a radial clearance relative to the housing and is localized by three resilient O-rings 14,15,16. The cylinder 13 is urged backwardly against the O-ring 16 by a cover 17 which in a suitable way, for instance by means of a lock bolt 53, is fixed relative to the housing 11 and can be regarded as a part thereof. A chisel sleeve 18 is axially slidable within the cylinder 13. Its axial movability is limited in that it is provided with a head 19 which in its forward end position abuts against a shoulder 20 on the cover 17. In its rear end position the head 19 abuts against a shoulder 21 in the cylinder 13. A chisel 22 is formed with a shank 23 which under slip fit extends through the chisel sleeve 18 and which has a shoulder 24 for taking support against the chisel sleeve. By means of a spring loaded hook 25, the chisel 22 is prevented from falling out forwardly and a spline connection 49 between the chisel 22 and the cover 17 prevents turning of the chisel. The outer and inner surfaces of the chisel sleeve 18 are cylindrical so that the latter is freely rotatable relative to the cylinder 13 as well as to the chisel 22.

A hammer piston 26 consists of the head 27 and a rearwardly extending neck 28. The cylinder 13 is formed with a portion 29 which under slip fit receives the piston head 27. The cylinder also have a constriction 30 which under slip fit receives the piston neck 28. The piston neck is formed with a cavity 31 which is closed by a cap 32. The wall of the piston neck has four openings 33. A passage 34 extends from the cavity 31 of the piston neck through the piston head 27 to the edge of the forward directed area 35 of the piston head. The passage 34 ends in a forward cylinder chamber 36 which is defined by the area 35 of the hammer piston on one side and by the chisel sleeve 18 and the chisel neck 23 on the other side.

Between the rear annular area 38 of the hammer piston head 27 and the constriction 30 there is formed a rear cylinder chamber 37. Behind the constriction 30 there is formed a discharged chamber 39 which communicates with the atmosphere through a discharge passage 40. A partition wall 41 carrying the O-ring 15 separates an accumulator chamber 42 from a pulsator chamber 43. The accumulator chamber 42 communicates continuously with the forward cylinder chamber 36 through four openings 44 in the cylinder 13. The pulsator chamber 43 communicates continuously with the rear cylinder chamber 37 through four openings 45.

The chipping hammer housing 11 is provided with a connection nipple 46 for a non-disclosed pressure air hose, and within the handle 12 there is a supply valve which is operable by means of a trigger 47.

When the supply valve is opened pressure air will enter the pulsator chamber 43 through a supply passage 48. Due to the openings 45, the rear cylinder chamber 37 is thereby continuously pressurized, and when the piston 26 is about its forward end position the openings 33 in the piston neck 28 are opened toward the rear cylinder chamber 37. Thereby pressure air is also supplied to the forward cylinder chamber 36 through these openings 33 in the piston neck, the cavity 31 in the piston neck and the passage 34 extending through the piston head. Because of the openings 44 the accumulator chamber 42 as well is pressurized as the forward cylinder chamber 36 is pressurized. Owing to the fact that the piston is a differential piston having its larger piston area 35 in the forward cylinder chamber 36, the piston is now forced backwardly. As the openings 33 in the piston neck are covered by the constriction 30 during the reverse movement of the piston the pressure of the comparatively large air volume enclosed in the piston, in the forward cylinder chamber 36 and in the accumulator chamber 42, continues to push the piston 26 backwardly. When, during the continued reverse movement of the piston, the openings 33 in the piston neck are opened toward the discharged chamber 39, the accumulator chamber 42 together with the forward cylinder chamber 36 and the interior of the piston is discharged, so that the constant air pressure acting on the smaller piston area 38 of the piston is able to retard the piston 26 and, thereupon, accelerate it forwards toward its impact position against the chisel neck 23, as shown in FIG. 1. When, during the forward movement of the piston, the openings 33 of the piston neck are reopened toward the rear cylinder chamber 37, pressure air supply to the interior of the piston is started, whereby the pressure in the forward cylinder chamber 36 is reestablished in order to return the piston as described.

If an adequate feeding force is applied on the chipping hammer housing 11, the chisel sleeve 18 does neither abut axially against the shoulder 20 of the cover 17 nor the shoulder 21 of the cylinder 13. Accordingly, the reaction force from the intermittently pressurized forward cylinder chamber 36 will be directly transferred to the chisel 22 and not at all to the chipping hammer housing 11. The reaction force arising in the rear cylinder chamber 37 acts on the constriction 30 of the cylinder and is transferred from the cylinder to the chipping hammer housing 11. This reaction force, however, is practically constant in that the pressure within the rear cylinder chamber is kept practically constant due to the large pulsator chamber 43.

Thus, the reciprocating movement of the piston does not generate any vibrations in the chipping hammer housing 11.

As the chipping hammer operates at no-load, e.g when the chisel 22 is not supported on a work piece and because of that no feeding force is applied, vibrations are transferable to the chipping hammer housing in that the hammer piston 26 is able to hit the chisel sleeve 18. Likewise, vibrations can be transferred to the chipping hammer housing if too large a feeding force is applied. In such a case the chisel sleeve 18 abuts axially against the shoulder 21 of the cylinder. These two situations can easily be avoided by the operator and for that reason they occur seldom and for short periods during normal operations.

Figure 4:
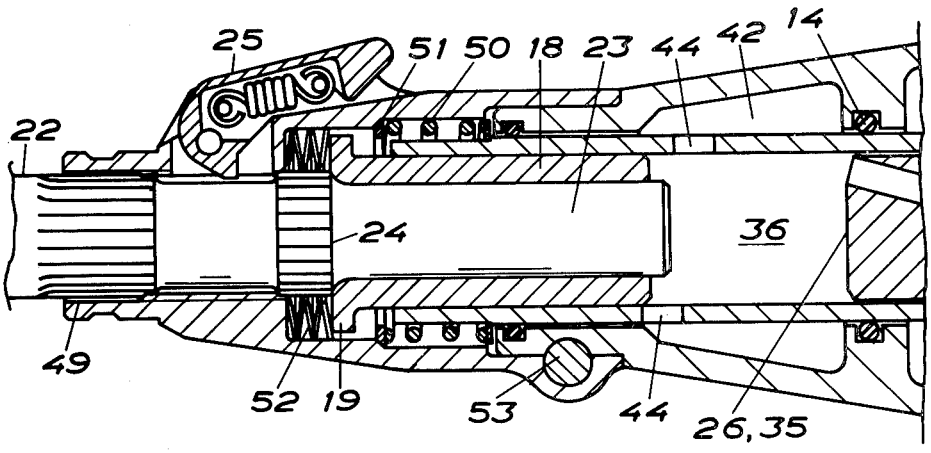
FIG. 4 shows a longitudinal section through the forward part of a chipping hammer according to the invention, wherein damping springs are fitted for absorb impact energy at no-load running.

In the modified embodiment according to FIG. 4 vibrations in the housing are avoided even though the chipping hammer operates at no-load or if too large a feeding force is applied. In this embodiment a preloaded coil spring 50 is fitted between the cover 17 and the cylinder 13 for urging the cylinder backwards and, thereby, retaining the latter in its proper position. Between the coil spring 50 and the cover 17 there is a washer 51. The chisel sleeve 18 is formed with a flange 19 which may take support forwardly against a non-preloaded spring 52 and backwardly against the washer 51. This spring is constituted by a number of Belleville springs. If the hammer piston 26 during no-load operation hits against the chisel sleeve 18 the vibrations in the housing 11 are mitigated by the Belleville springs 52. The coil spring 50 is preloaded for instance to 1 kp and the operator will notice that he applies too big a feeding force because the chisel sleeve 18 then abuts against the washer 51. The coil spring 50 has to be compressed a few millimeters before the flange 19 of the chisel sleeve takes support against the cylinder 13. It is not necessary that coil spring 50 urges the cylinder backwards with a larger force than about 1 kp because the constant air pressure within the rear cylinder chamber 37 urges the cylinder backwards as well.

The invention is not limited to the described and shown embodiments but can be freely varied within the scope of the claims.

What we claim is:

1. Pneumatic impact tool for driving a working implement having a shank portion, comprising:

a cylinder having a front opening for receiving the shank portion of a working implement such that said working implement is movable axially relative to said cylinder;

a differential hammer piston reciprocably powered in said cylinder, said hammer piston having a large piston area facing the impact direction; and a small piston area facing the reverse direction;

said hammer cylinder comprising a rear, continuously pressurized drive chamber for imparting a substantially uniform forward directed driving force on said small, reverse direction facing piston area; and a forward, intermittently pressurized drive chamber for imparting a periodically acting, backward directed driving force on said large, impact direction facing piston area; and said cylinder including means for retaining said working implement so that said working implement receives the entire reaction force resulting from said periodically acting, backward directed driving force imparted by said forward drive chamber of said cylinder, whereby said cylinder is prevented from being influenced by said periodically acting force.

2. Impact tool according to claim 1, comprising a support sleeve slidably mounted in said cylinder for axially supporting said working implement shank portion; and wherein said forward cylinder chamber is at its front end defined partly by said support sleeve and partly by said working implement shank portion.

3. Pneumatic tool for driving a working implement having a shank portion, comprising:

a housing having a front opening for receiving the shank portion of the working implement;

a cylinder mounted in said housing and including means for receiving the shank portion of the working implement introduced through said front opening of said housing;

a differential hammer piston reciprocably powered in said cylinder, said hammer piston having one large piston area facing the impact direction; and two smaller piston areas facing the reverse direction;

said cylinder comprising a rear, continuously pressurized drive chamber for imparting a substantially uniform, forward directed driving force on one of said smaller, reverse direction facing piston areas; and a forward, intermittently pressurized drive chamber for imparting a backward directed, periodically acting driving force on said large, impact direction facing piston area;

said working implement being axially movable relative to said cylinder and said cylinder including means for receiving said working implement so that said working implement receives the entire reaction force resulting from said backward directed, periodically acting driving force imparted by said forward drive chamber; and said cylinder further comprising a low pressure chamber continuously maintained at atmospheric pressure, said other of said two smaller, reverse direction facing piston areas in one direction defining said low-pressure chamber.

4. Impact tool according to claim 3 wherein said cylinder is detachably mounted to said housing and is introduced into said housing through said front opening; and comprising a spring coupled to said cylinder to urge said cylinder backwards into its position in said housing.

5. Impact tool according to claim 4, further comprising a support sleeve slidably mounted in said cylinder for axially supporting said shank portion of the working implement; and wherein said forward cylinder chamber is at its front end defined partly by said support sleeve and partly by said shank portion of the working implement which protrudes rearwardly from said support sleeve.

6. Pneumatic impact tool for driving a working implement having a shank portion, comprising:

a housing;

a pressure air supply means in said housing;

a cylinder secured in said housing, and including means for receiving at its forward end the shank portion of the working implement;

a differential hammer piston reciprocably powered in said cylinder, said piston having a large diameter piston head facing its impact direction; and a small diameter neck extending in its reverse direction;

said cylinder having between both of its ends a constricted portion for receiving with a slip fit said hammer piston neck;

said cylinder further comprising a rear drive chamber which is axially defined by said constricted portion and said hammer piston head; and a forward drive chamber which is axially defined by said hammer piston head and said working implement shank portion;

a first accumulator chamber continuously interconnecting said rear drive chamber and said pressure air supply means;

a second accumulator chamber continuously communicating with said forward drive chamber; and interacting valve means on said hammer piston and said cylinder for alternately connecting said forward drive chamber and said second accumulator chamber to said first accumulator chamber and to the atmosphere for reciprocating said hammer piston within said cylinder.

7. Pneumatic impact tool according to claim 6, wherein said cylinder is tube-shaped; and said first and second accumulator chambers are defined by the outer periphery of said cylinder and said housing.

8. Pneumatic impact tool according to claim 7, wherein said second accumulator chamber is annular and situated in front of said first accumulator chamber; and said housing includes an annular wall separating said second accumulator chamber from said first accumulator chamber.

9. Impact tool according to claim 8, wherein said housing surrounds said cylinder and includes means defining a space which communicates with said pressure air supply means as well as said rear cylinder chamber and which forms said first accumulator chamber.

10. Impact tool according to claim 9, wherein said cylinder is detachably mounted to said housing; and comprising means for retaining said cylinder elastically in said housing axially as well as radially.

11. Impact tool according to claim 10, comprising a spring coupled to said cylinder to urge said cylinder axial rearwardly into position in said housing.

12. Pneumatic impact tool, for driving a working implement having a shank portion, comprising:

a working cylinder (13) located in a housing;

a sleeve member (18) in said working cylinder (13) into which said working implement (22) is slidably mounted;

a reciprocable hammer piston (26) slidably mounted in said working cylinder (13), the hammer piston (26) having front and rear face surfaces respectively defining front and rear working chambers (36,37) within said working cylinder (13), said sleeve member (18) at least partially defining said front working chamber (36) and said front working chamber (36) extending between said piston head (27) and the inserted working implement (22);

said hammer piston (26) being a differential piston having a head (27) with a sliding seat and slidable in said working cylinder (13), and a neck (28) which joins the rear of the head (27) and passes through a cylindrical narrowed portion (30) in said working cylinder (13) with a sliding fit;

said rear working chamber (37) being located between said piston head (27) and said cylindrical narrowed portion (30), and being continuously fed with a substantially constant supply of air pressure;

means for continuously venting the portion of said working cylinder (13) located behind said narrowed portion (30); and a control means responsive to the position of said hammer piston (26) for supplying said front working chamber (36) with supply air pressure for the return stroke of said hammer piston (26) and for venting said front working chamber (36) for the working stroke of said hammer piston (26);

the overall reaction force exerted by the air pressure in said rear working chamber (37) being accepted by the tool housing free from vibration whereas the entire reaction force due to the air pressure in said front working chamber (36) is accepted by said working implement (22).

* * * * *